United States Patent [19]

Gunther, Jr.

[11] Patent Number: 5,000,657

[45] Date of Patent: Mar. 19, 1991

[54] TWO-WAY CONVEYOR

[75] Inventor: William H. Gunther, Jr., Mystic, Conn.

[73] Assignee: Gunther International, Ltd., Mystic, Conn.

[21] Appl. No.: 299,666

[22] Filed: Jan. 23, 1989

[51] Int. Cl.[5] ..... B65H 31/30; B65H 43/00

[52] U.S. Cl. ..... 414/790.3; 198/358; 198/365; 198/366; 414/789

[58] Field of Search ..... 198/358, 365, 366, 371, 198/372, 854; 414/789, 790.1, 790.3, 790.2, 790.7; 209/551

[56] References Cited

U.S. PATENT DOCUMENTS

| | | | |
|---|---|---|---|
| 2,641,974 | 6/1953 | Sperling et al. | 414/790.3 X |
| 3,182,537 | 5/1965 | Grody | 414/790.3 X |
| 3,830,144 | 8/1974 | Kuckhermann et al. | 414/790.7 X |
| 4,363,584 | 12/1982 | Kokubo | 414/789.9 X |

*Primary Examiner*—Robert J. Spar

*Assistant Examiner*—Janice Krizek

*Attorney, Agent, or Firm*—Stoll, Previto & Hoffman

[57] ABSTRACT

A two-way conveyor having an accumulating station for accumulating a plurality of sheets. A mechanism for determining in which direction the sheets are to be moved is also provided as well as a mechanism for moving the sheets in one direction or the other. A thickness detecting mechanism is also provided to determine the thickness of the stack and the stack is moved in one direction or the other depending on its thickness. Gates are provided for preventing the movement of the stack in either direction which comprises gates at the forward and rearward edge of the stack and a closing mechanism is provided for closing the gate to prevent movement of the stack in either direction. Gate opening mechanisms are provided for opening one of said gates to permit movement of the stack in the desired direction. The gates are preferably pivotal gates located at the forward and rearward portions of the stack.

9 Claims, 2 Drawing Sheets

TWO-WAY CONVEYOR

BACKGROUND

The present invention relates to a two-way conveyor and, more particularly, to a two-way conveyor mechanism which permits stacks to be moved either in one direction or in the opposite direction depending upon the size of the stack.

During certain automatic operations where stacks of sheets are processed and inserted into envelopes, depending upon its thickness, the stack is either placed on an envelope blank which is folded around the stack to form an envelope or the stack is inserted (stuffed) into a pre-formed envelope.

Heretofore, when envelopes of different sizes are necessary because stacks of different thicknesses are to be inserted therein, it was necessary to either determine what the size of the envelope would be and thereafter place the stack for a particular size envelope into a particular machine for stuffing purposes or to place the stack in a different machine to be stuffed into an envelope. As will be appreciated, these are time consuming operations and not well suited to high speed stuffing. Alternately, it was sometimes necessary to manually take a particular stack from the stacking machine and place it in the proper enveloping machine.

OBJECT OF INVENTION

The present invention overcomes these problems and has for one of its objects the provision of a mechanism which will automatically move the stack either to an envelope folding mechanism or to a stuffing mechanism.

Another object of the present invention is to provide a two-way diverter mechanism in a single module which will automatically move the stack in one direction to an envelope stuffing mechanism or in the opposite direction to an envelope folding mechanism.

BRIEF DESCRIPTION OF INVENTION

The improved diverter mechanism comprises a stacking area in which sheets accumulate. A pair of diverter sprocket wheels with pushers attached hereto are provided. The pushers are mounted on separate conveyor chains which move in opposite directions. If the stack of sheets is to be moved in the usual forward direction, the main conveyor chain, through its pushers, moves the stack in the forward direction. If the stack is to be moved in the opposite direction, diverter sprocket means are activated to move a diverter conveyor and pushers to strike one edge of the stack and move the stack along the conveyor in the opposite direction.

DESCRIPTION OF CONVEYOR

DESCRIPTION OF INVENTION

Figure 1:
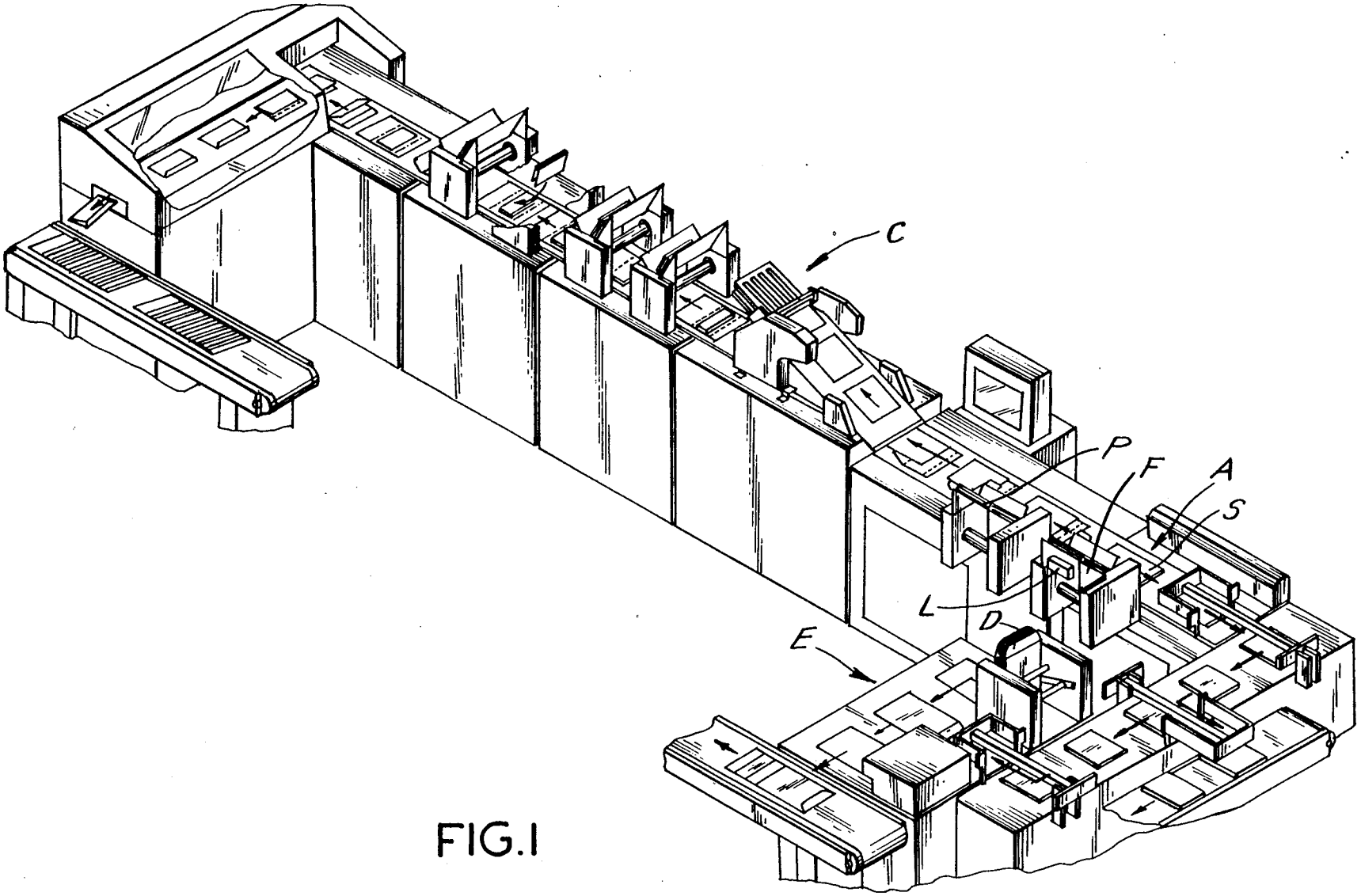
FIG. 1 is a schematic view of a mechanism with which the two-way conveyor mechanism of the present invention may be used.

Referring to the drawings and more particularly to FIG. 1, the sheets are stacked in a stack S in a stacking area A. The mechanism feed sheets of paper P one-by-one to the stacking area A from a feeder assembly F. The sheets are scanned by a laser scanner L which activates a computer to determine how many sheets P are to be in the stack S before they are moved out of the stacking area A.

When the laser scanner L counts the correct number of sheets p to be stacked in the stack S in stacking area A, they are moved to an enveloping station. In one direction, the stack S of sheets p are fed to an envelope mechanism C which folds the envelope around the stack S as is fully described in my U.S. Pat. Nos. 4,694,631 and 4,694,632. In the opposite direction, the stack is moved to an envelope stuffing station E where the stack of sheets S is stuffed into a larger envelope D.

The sheets P are fed by the feeder F to the stacking area A which comprises a stacking plate 1 of side guides 2A and 2B at each end thereof pivotally mounted around pivot 3 for upward movement. Both side guides 2A and 2B are lowered during the feeding operation in order to permit the sheets P to be stacked in stack S on stacking plate 1 in a uniform manner. After the sheets S are fed and they are to be moved in either direction to be enveloped, either one of the side guides 2A or 2B are pivoted upwardly to permit the stack S of sheets p to be moved in either direction.

Figure 2:
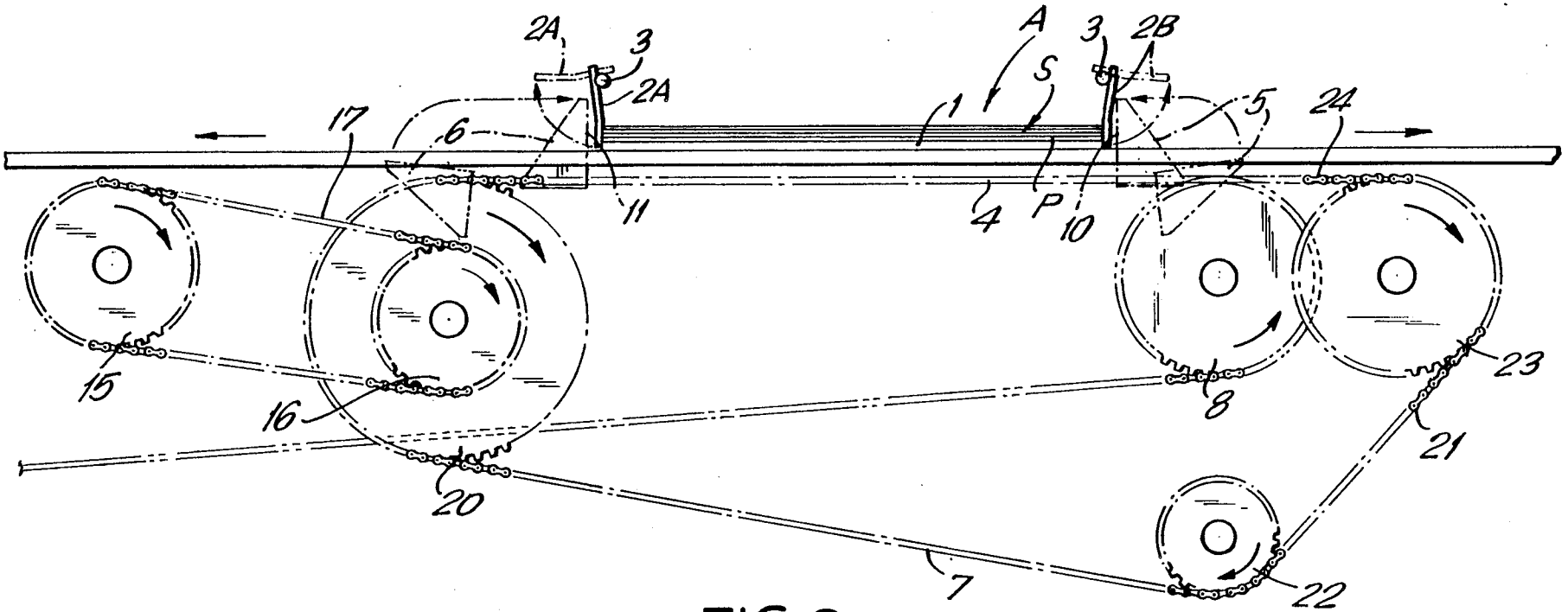
FIG. 2 shows a schematic view of the mechanism for moving the stack in opposite directions.

As the sheets p are stacked on a stacking plate 1, the side guides 2A and 2B are in their downward position as shown in FIG. 2. In this position, the sheets P accumulate in the stack S until the necessary predetermined number of sheets P are accumulated thereon. When this occurs, either the front guide 2A or the rear guide 2B is pivoted upwardly and the stack S of sheets P is free to move in one direction or another. If the stack is not too thick and an envelope can be wrapped around it, the front guide 2A pivots upwardly and the stack moves in one direction to have an envelope wrapped around it. However, if the stack is much larger and too thick to have an envelope folded around it, when the sheets reach the desired thickness, the rear guide 2B is pivoted upwardly thereby permitting the stack S to move in the opposite direction to be thereafter moved to the envelope module E so that they can be stuffed into a larger envelope D.

The moving means for moving the stack comprise a main conveyor chain 4 having a plurality of pushers 5 thereon and a diverter chain 7 provided with pushers 6.

The main conveyor chain 4 is provided with and is operated by a main conveyor drive roller (not shown) which is wrapped around a main idler roller 8. Pushers 5 are triangular in shape and each has a forward face 10 which is adapted to strike the rear edge of the stack S of sheets P to move it forward. The main conveyor chain 4 moves in a forward direction only. The pushers 5 thereon are attached to it so that they move upwardly when the chain 4 is in its upper run and are in their lowered position when the chain 4 is in its inactive lower run position.

The diverter conveyor chain 7 is controlled by a diverter drive sprocket 15 and a diverter driven sprocket 16 through chain 17. A divert conveyor drive sprocket 20 is controlled by the diverter driven sprocket 16 which has chain 41 moving over a divert tension sprocket 22 and idler sprocket 23. The divert chain 21 has pushers 6 with flat front faces 11. Its upper run 24 is on the same plane as the upper run of the main chain.

Ordinarily, the main conveyor chain 4 is moving in a forward direction under the influence of the main conveyor drive (not shown). However, when the stack S is to move in the opposite direction, the divert drive sprocket 15 is activated which drives the divert driven sprocket 16. This, in turn, rotates the divert conveyor drive sprocket 20 thereby moving the divert conveyor chain 7 in the opposite direction.

If a predetermined number of sheets P, i.e., four, are to be fed to stack plate 1, the first side guides 2A move up and the main drive chain 4 is indexed forwardly. The pushers 5 strike the rear edge of the stack S and move it, in index fashion, to the next station where it will eventually have an envelope wrapped about it.

However, if more than the four sheets are to be fed, the diverter drive sprocket 15 is activated by the computer. The diverter drive sprocket controls the diverter driven sprocket 16 which, in turn, is on the same axis as the divert conveyor drive sprocket 20 and rotates that sprocket. The divert conveyor chain 7 has a divert tension sprocket 22 as well as a divert idler sprocket 23. The chain 21 has the pusher 6 with the operative faces 11 facing in the direction opposite to the direction of the pushers 5. Thus, if more than four sheets are fed to the stacking area A, side guides 2B are raised and the divert conveyor chain 7 and its pushers 6 move in the opposite rearward direction and move the stack S in the rear direction so that they will eventually be stuffed into the larger envelope E at the stuffing station.

It will thus be seen that the present invention provide a mechanism which will automatically move the stack either to an envelope folding mechanism or to a stuffing mechanism and specifically an improved two-way diverter mechanism in a single module which will automatically move the stack in one direction to an envelope stuffing mechanism or in the opposite direction to an envelope folding mechanism.

As many and varied modifications of the subject matter of this invention will become apparent to those skilled in the art from the detailed description given hereinabove, it will be understood that the present invention is limited only as provided in the claims appended hereto.

The embodiment of the invention in which as exclusive property or privilege is claimed are claimed as follows:

1. A two-way sheet-directing mechanism comprising means at an accumulating station for accumulating sheets, means for determining in which direction the sheets are to move and for moving the sheets in one direction or the other, said accumulating station being adapted to receive a plurality of sheets in a stack, said direction-determining means comprising means to determine the thickness of the stack and wherein the stack is moved in one direction or the other depending on the thickness of the stack, said accumulating station comprising gate means for preventing the movement of the stack in either direction, and said gate means comprising gates at the forward and rearward edge of the stack wherein means are provided for closing the gates to prevent movement of the stack in either direction.

2. A mechanism as claimed in claim 1 wherein means are provided for opening one of said gates to permit movement of the stack in the desired direction.

3. A mechanism as claimed in claim 2 wherein said gates are pivotal gates located at the forward and rearward portions of the stack.

4. A mechanism as claimed in claim 3 wherein pusher means are adapted to push the stack in one direction or the other.

5. A mechanism as claimed in claim 4 wherein a pair of pusher means are provided which, upon activation, push the stack in one direction or the other.

6. A mechanism as claimed in claim 5 wherein said pusher means are mounted on separate drive mechanisms and the activation of said drive mechanism permits the stack to move in one direction or the other.

7. A mechanism as claimed in claim 6 wherein said drive mechanism comprises a chain mechanism.

8. A mechanism as claimed in claim 7 wherein a main drive mechanism is provided and wherein the pusher drive mechanism is in relationship to said main drive mechanism.

9. A mechanism as claimed in claim 8 wherein each directional drive mechanism is selectively engaged by the main mechanism in order to move the stack in one direction or the other.

* * * * *